US007619367B2

(12) United States Patent
Van Zundert et al.

(10) Patent No.: US 7,619,367 B2
(45) Date of Patent: Nov. 17, 2009

(54) ELECTRONIC BALLAST PROTECTION

(75) Inventors: Roy Hendrik Anna Maria Van Zundert, Eindhoven (NL); Subramanian Muthu, Hoffman Estates, IL (US); Wouter Edgard Koen Broeckx, Dessel (BE); Gerlach Corne Pieter Maria Emmen, Ravels-Eel (BE); Oscar Jan Deurloo, Rosmalen (NL); Lukas Leyten, Waalre (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 520 days.

(21) Appl. No.: 11/571,775

(22) PCT Filed: Jul. 7, 2005

(86) PCT No.: PCT/IB2005/052268

§ 371 (c)(1),
(2), (4) Date: Jan. 8, 2007

(87) PCT Pub. No.: WO2006/006136

PCT Pub. Date: Jan. 19, 2006

(65) Prior Publication Data

US 2008/0297956 A1 Dec. 4, 2008

Related U.S. Application Data

(60) Provisional application No. 60/586,947, filed on Jul. 9, 2004, provisional application No. 60/602,895, filed on Aug. 19, 2004.

(51) Int. Cl.
*H05B 39/00* (2006.01)

(52) U.S. Cl. ..... 315/160; 315/86; 315/91; 315/119

(58) Field of Classification Search ..... 315/86, 315/88, 91, 119, 127, 160, 170, 171, 172, 315/176, 246, 291, 295, 299, 306, 307, 308
See application file for complete search history.

(56) References Cited

U.S. PATENT DOCUMENTS 5,783,908 A 7/1998 Toda et al.

(Continued)

FOREIGN PATENT DOCUMENTS

DE 10127135 A1 12/2002

(Continued)

OTHER PUBLICATIONS

"A study of high intensity discharge lamp-electronic ballast interface" Fellow, M.W.; Industry Applications Conference, 2003, 38th IAS Annual Meeting, Conference Record of the, vol. 2, Oct. 12-16, 2003, pp. 1043-1048 vol. 2, Topic 8 . Ignition Techniques.

*Primary Examiner*—Douglas W Owens
*Assistant Examiner*—Jianzi Chen

(57) ABSTRACT

A method of electronic ballast protection including providing an electronic ballast having an AC/DC converter 104 with an electronic ballast input and a mains voltage connection 103 connectable to a mains voltage 102, an inverter 120 operably connected to the AC/DC converter 104 and having an electronic ballast output 125 connectable to a lamp 124, a control circuit 116 controlling the inverter 120, and a low voltage power supply 114 providing low voltage power to the control circuit 116; supplying power to the low voltage power supply 114 from the electronic ballast input when the mains voltage connection 103 is wired to mains voltage 102; and disconnecting the power to the low voltage power supply 114 when the electronic ballast output 125 is wired to the mains voltage 102.

33 Claims, 5 Drawing Sheets

U.S. PATENT DOCUMENTS

| | | | | |
|---|---|---|---|---|
| 5,828,177 | A | 10/1998 | Toda et al. | |
| 6,160,362 | A | 12/2000 | Shone et al. | |
| 6,498,436 | B2 * | 12/2002 | Hartge et al. | 315/86 |
| 6,541,926 | B1 | 4/2003 | Forghieri | |
| 6,759,813 | B2 | 7/2004 | Busse et al. | |
| 2002/0047635 | A1 | 4/2002 | Ribarich et al. | |

FOREIGN PATENT DOCUMENTS

| | | | |
|---|---|---|---|
| WO | 03055281 | A1 | 7/2003 |

* cited by examiner

ELECTRONIC BALLAST PROTECTION

CROSS REFERENCE TO RELATED APPLICATION

This application claims the benefit of U.S. provisional application Ser. No. 60/602,895, filed Aug. 19, 2004 and application Ser. No. 60/586,947, filed Jul. 9, 2004 which the entire subject matter is incorporated herein by reference.

This invention relates generally to lighting systems, and more specifically to electronic ballast protection.

Gas discharge lamps, such as fluorescent lamps and high intensity discharge (HID) lamps, require a ballast to limit the current to the lamp. Electronic ballasts have become increasingly popular due to their many advantages. Electronic ballasts provide greater efficiency—as much as 15% to 20% over magnetic ballast systems. Electronic ballasts produce less heat, reducing building cooling loads, and operate more quietly, without "hum." In addition, electronic ballasts offer more design and control flexibility.

FIG. 1 is a schematic diagram of an exemplary electronic ballast circuit for a HID lamp. The electronic ballast 100 receives mains voltage 102 at mains voltage connection 103 and converts the mains voltage 102 to DC bus voltage on DC bus 112 with AC/DC converter 104. The AC/DC converter 104 includes an EMI filter 106, a diode bridge 108 connected to the EMI filter 106 at EMI filter-diode bridge connection 107, and a DC/DC converter 110 connected to the diode bridge 108 at diode bridge-DC/DC converter connection 109. A low voltage power supply 114 is connected to the DC bus 112 and provides low voltage power to control circuit 116. The control circuit 116 including microprocessor 118 controls the inverter 120, which includes MOSFETs S1, S2, S3, S4, and filter circuit 128, which incorporates inductors and capacitors. The MOSFETs S1, S2, S3, and S4 are switched to convert the DC bus voltage on the DC bus 112 to output power on electronic ballast output 125. The electronic ballast output 125 supplies lamp 124. Resonant circuit 126, which includes resonant inductor LR and resonant capacitor CR, is connected across the electronic ballast output 125 to provide the high ignition voltage required to start the lamp 124. Those skilled in the art will appreciate that a number of topologies, such as half-bridge inverters, are possible for the electronic ballast circuit and the resonant circuit.

One particular challenge is to protect the electronic ballast during installation and startup. The electronic ballast includes electronic components which can be damaged by high currents if the electronic ballast is miswired during installation. Other electronic ballast components fail over time due to temperature and thermal stresses from igniting the lamp.

Presently, correct wiring of the electronic ballasts depends on the skill and care of the installer. The location of the label on the ballast housing and the color coding of the wires are the only means to determine which wires should be connected to the mains voltage and which wires should be connected to the lamp. Miswiring the electronic ballast, e.g., switching the mains voltage connection and the lamp connection, will damage the electronic ballast when mains voltage is applied. If the mains voltage is applied to the ballast output, the DC bus is energized and the low voltage power supply provides power to the control circuit. The control circuit switches the MOSFETs, shorting the mains voltage through the diode of a MOSFET which is off, the MOSFET which is on, and the filter circuit. The short circuit continues until the MOSFET is damaged and opens, or an external circuit breaker opens. The MOSFET damage renders the electronic ballast inoperable.

Electronic ballast components are subject to high temperatures and thermal stresses when igniting the lamp. During lamp startup, the resonant circuit provides a high ignition voltage on the ballast output. The ignition voltage is a sustained ignition pulse containing high frequency voltage components. The resonant current, which flows through the resonant inductor and the resonant capacitor of the resonant ignitor, is high and energy is dissipated as heat in the resonant inductor. The higher the ignition voltage and longer the ignition voltage is applied, the more heat builds up in the resonant inductor and raises inductor temperature. When the core temperature of the inductor coil exceeds its rated limits, core breakdown occurs and renders the electronic ballast inoperable.

Another problem occurs with electronic ballasts using sweeping startups. In some electronic ballasts, the inverter frequency sweeps downward as the ignition voltage sweeps upward to overcome the effect of cable capacitance and reach the resonant frequency producing the required peak voltage. This further degrades the inductor by allowing heat buildup during the approach to the resonant frequency. In addition, a slow ignition voltage sweep reduces the likelihood of successful ignition, requiring repeated startup attempts.

It would be desirable to have electronic ballast protection that overcomes the above disadvantages.

One aspect of the present invention provides a method of electronic ballast protection including providing an electronic ballast having an AC/DC converter with an electronic ballast input and a mains voltage connection connectable to a mains voltage, an inverter operably connected to the AC/DC converter and having an electronic ballast output connectable to a lamp, a control circuit controlling the inverter, and a low voltage power supply providing low voltage power to the control circuit; supplying power to the low voltage power supply from the electronic ballast input when the mains voltage connection is wired to mains voltage; and disconnecting the power to the low voltage power supply when the electronic ballast output is wired to the mains voltage.

Another aspect of the present invention provides a system of electronic ballast protection including an electronic ballast having an AC/DC converter with an electronic ballast input and a mains voltage connection connectable to a mains voltage, an inverter operably connected to the AC/DC converter and having an electronic ballast output connectable to a lamp, a control circuit controlling the inverter, and a low voltage power supply providing low voltage power to the control circuit; means for supplying power to the low voltage power supply from the electronic ballast input when the mains voltage connection is wired to the mains voltage; and means for disconnecting the power to the low voltage power supply when the electronic ballast output is wired to the mains voltage.

Yet another aspect of the present invention provides an electronic ballast with ballast protection including an AC/DC converter receiving mains voltage at a mains voltage connection and generating DC bus voltage from the mains voltage, the AC/DC converter having an electronic ballast input; an inverter receiving the DC bus voltage and generating output power at an electronic ballast output connectable to a lamp; a control circuit controlling the inverter; and a connection sensor operably connected to a location selected from the group consisting of the electronic ballast input and the electronic ballast output, wherein the connection sensor provides a connection sensor signal to the control circuit, and the control circuit shuts down the inverter when the connection sensor signal is not an expected connection sensor signal, lack of the expected connection sensor signal resulting from a miswire selected from the group consisting of connection of the mains voltage with the electronic ballast output and connection of the lamp with the mains voltage connection.

Yet another aspect of the present invention provides a method of electronic ballast protection including providing an electronic ballast having an electronic ballast input connectable to a mains voltage and an electronic ballast output connectable to a lamp, monitoring an electronic ballast parameter at a location selected from the group consisting of the electronic ballast input and the electronic ballast output, and shutting down the electronic ballast when the electronic ballast parameter is not an expected electronic ballast parameter, lack of the expected connection sensor signal resulting from a miswire selected from the group consisting of connection of the mains voltage with the electronic ballast output and connection of the lamp with the electronic ballast input.

Yet another aspect of the present invention provides a system of electronic ballast protection including an electronic ballast having an electronic ballast input connectable to a mains voltage and an electronic ballast output connectable to a lamp, means for monitoring an electronic ballast parameter at a location selected from the group consisting of the electronic ballast input and the electronic ballast output, and means for shutting down the electronic ballast when the electronic ballast parameter is not an expected electronic ballast parameter, lack of the expected connection sensor signal resulting from a miswire selected from the group consisting of connection of the mains voltage with the electronic ballast output and connection of the lamp with the electronic ballast input.

Yet another aspect of the present invention provides a method of electronic ballast protection including providing an electronic ballast having an electronic ballast output, and generating an ignition voltage at the electronic ballast output during lamp startup, the ignition voltage comprising a series of ignition voltage pulses, wherein the series of ignition voltage pulses are timed so as to limit component temperature in the electronic ballast.

Yet another aspect of the present invention provides a system of electronic ballast protection comprising an-electronic ballast having an electronic ballast output, and means for generating an ignition voltage at the electronic ballast output during lamp startup, the ignition voltage comprising a series of ignition voltage pulses, wherein the series of ignition voltage pulses are timed so as to limit component temperature in the electronic ballast.

The foregoing and other features and advantages of the invention will become further apparent from the following detailed description of the presently preferred embodiment, read in conjunction with the accompanying drawings. The detailed description and drawings are merely illustrative of the invention rather than limiting, the scope of the invention being defined by the appended claims and equivalents thereof.

Figure 1:
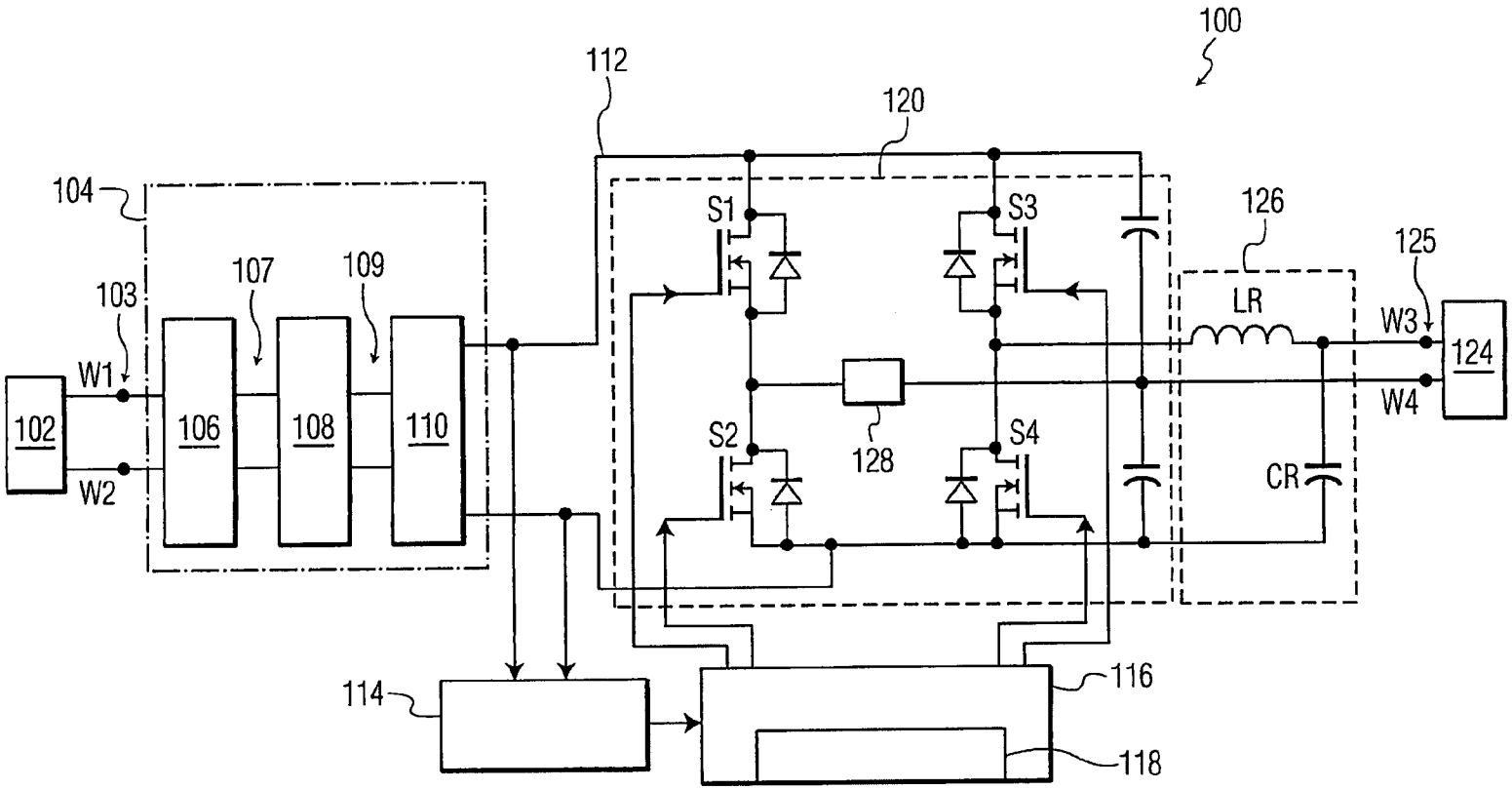
FIG. 1 PRIOR ART
FIG. 1 is a schematic diagram of an exemplary electronic ballast circuit.
Figure 2:
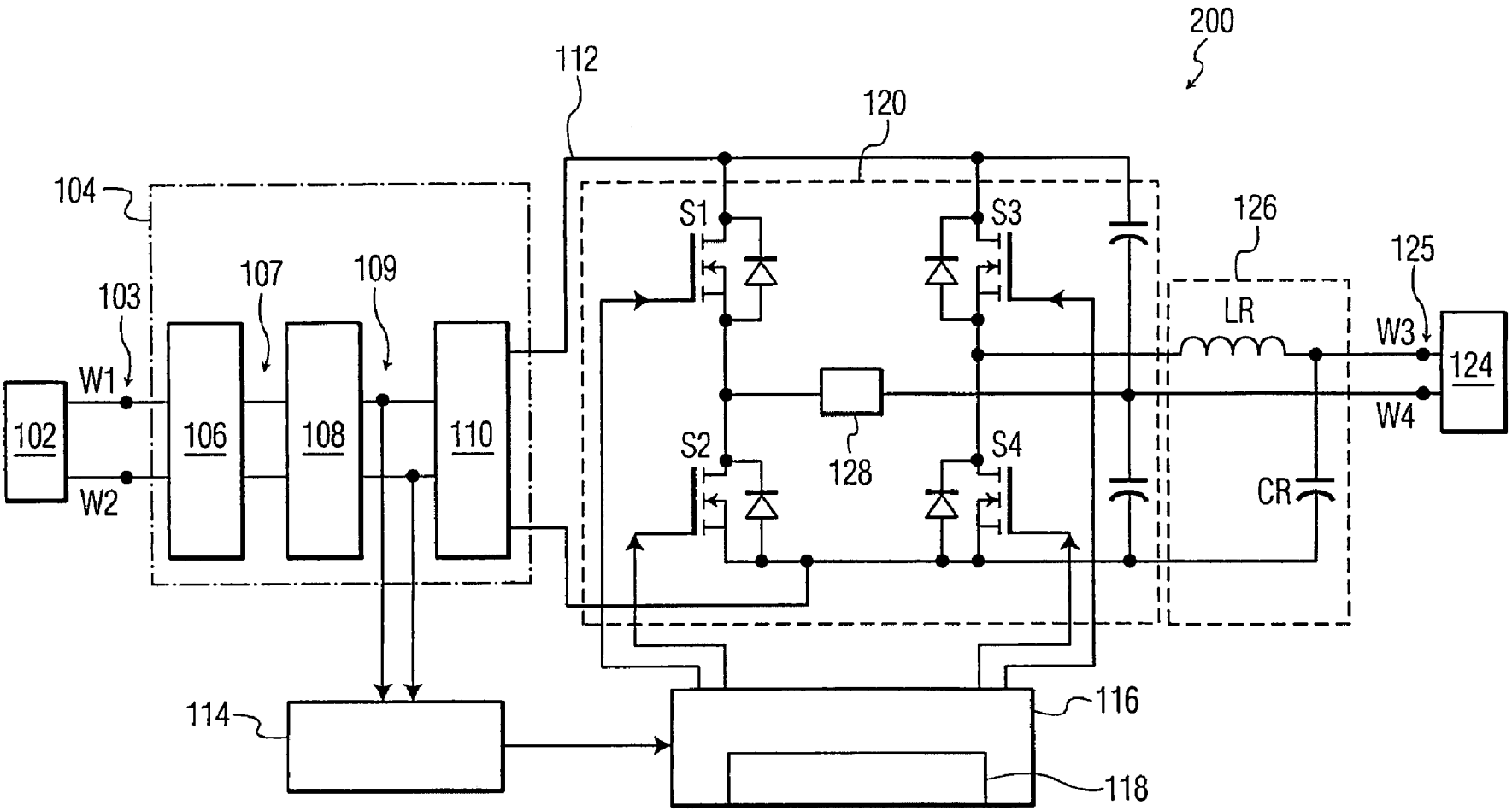
FIGS. 2 & 3 are schematic diagrams of electronic ballast circuits with ballast miswiring protection made in accordance with the present invention.
Figure 3:
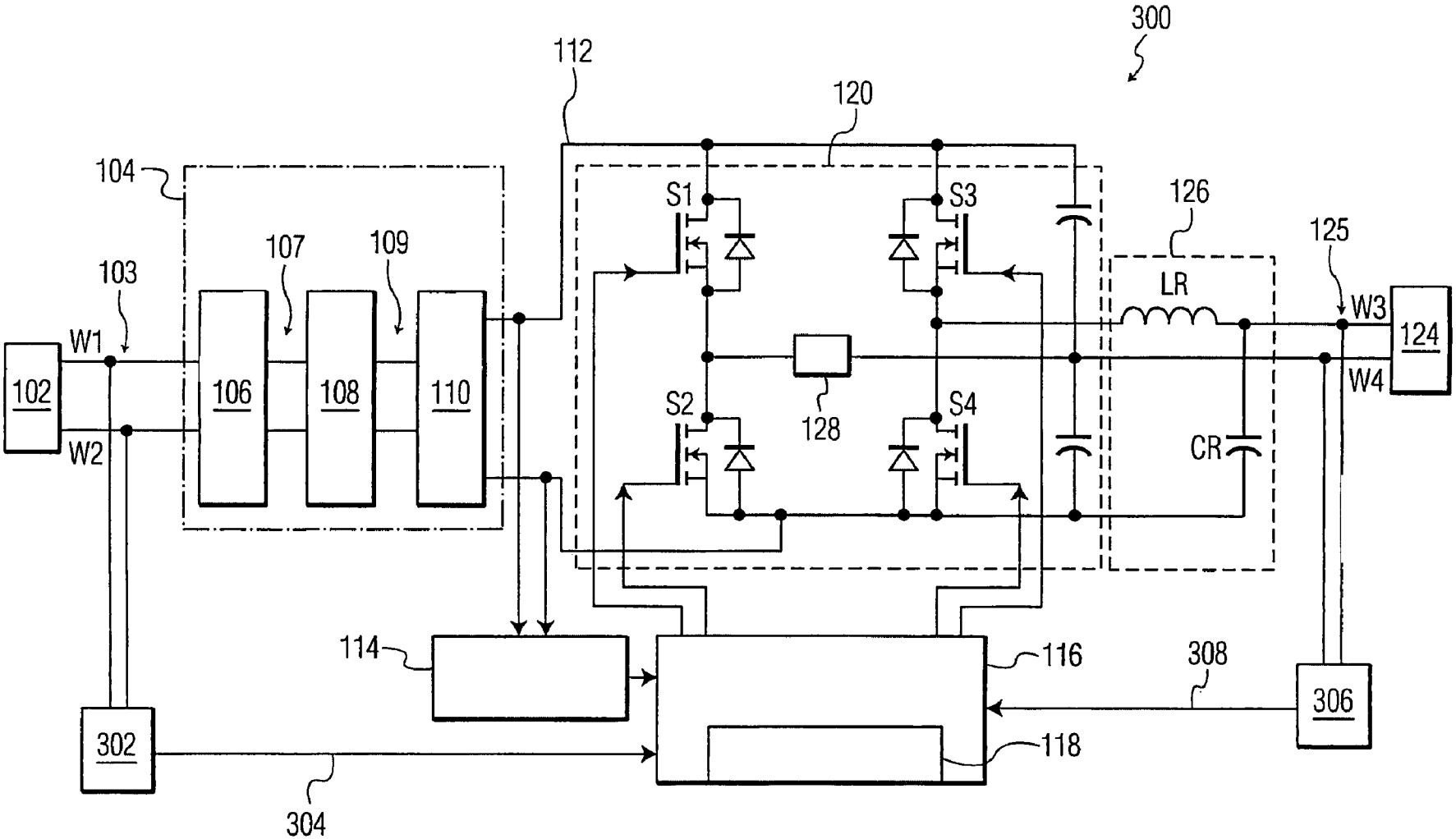

FIGS. 2 & 3, in which like elements share like reference numbers with FIG. 1, are schematic diagrams of electronic ballast circuits with ballast miswiring protection made in accordance with the present invention. The ballast miswiring protection protects the electronic ballast when the wires at mains voltage connection 103 or electronic ballast output 125 are wired incorrectly during installation.

FIG. 2 is an exemplary embodiment of an electronic ballast circuit with passive ballast miswiring protection. The ballast miswiring protection is achieved by connecting the low voltage power supply 114 at the electronic ballast input, so that the low voltage power supply 114 is isolated from the DC bus 112. The electronic ballast input is defined as any location in the electronic ballast 200 operably connected to the mains voltage 102 before the DC bus 112. In the embodiment illustrated, the low voltage power supply 114 is connected to the electronic ballast input at the diode bridge-DC/DC converter connection 109. In alternative embodiments, the low voltage power supply 114 is connected to the mains voltage connection 103 or the EMI filter-diode bridge connection 107.

When the electronic ballast 200 is correctly wired, with the mains voltage connection 103 wired to the mains voltage 102, the low voltage power supply 114 is powered from the electronic ballast input. Should the electronic ballast 200 be incorrectly wired during installation, such as by connecting the electronic ballast output 125 to the mains voltage 102, the low voltage power supply 114 will not receive power from the mains voltage 102, the control circuit 116 will remain deenergized, and the inverter 120 will not switch. This prevents short circuiting the mains voltage 102 through the MOSFETs S1, S2, S3, S4, and filter circuit 128 of the inverter 120, preventing damage to the electronic ballast 200.

FIG. 3 is an exemplary embodiment of an electronic ballast circuit with active ballast miswiring protection. The ballast miswiring protection is achieved by monitoring an electronic ballast connection and shutting down the electronic ballast when the expected indication is not detected.

In one embodiment, an input sensor 302 as a connection sensor is connected to the electronic ballast input. The electronic ballast input is defined as any location in the electronic ballast 200 operably connected to the mains voltage 102 before the DC bus 112. In the embodiment illustrated, the input sensor 302 is connected to the electronic ballast input at the mains voltage connection 103. In alternative embodiments, the input sensor 302 is connected to the EMI filter-diode bridge connection 107 or the diode bridge-DC/DC converter connection 109. The input sensor 302 can be a voltage sensor or a current sensor, as desired. The input sensor 302 provides an input sensor signal 304 as a connection sensor signal to the control circuit 116.

When power is applied to the electronic ballast 300, the input sensor 302 monitors the electronic ballast input for an electronic ballast parameter, such as input voltage or input current, and provides the input sensor signal 304 to the control circuit 116. The control circuit 116 determines whether the input sensor signal 304 is the expected connection sensor signal. The expected connection sensor signal is signal present at startup, indicating voltage or current on the electronic ballast input. When the electronic ballast 300 has been properly wired, the input sensor signal 304 indicates the mains voltage 102 supplying power and the connection sensor signal is signal present. The electronic ballast operation is allowed to continue. When the electronic ballast 300 has been miswired, such as wiring the mains voltage connection 103 to the lamp 124, the input sensor signal 304 indicates no power. Because the expected connection sensor signal is signal present and the connection sensor signal indicates no signal present, the control circuit 116 determines that miswiring has occurred and shuts down the inverter 120 to shut down the electronic ballast 300. When the electronic ballast parameter is not the expected electronic ballast parameter, the electronic ballast is shut down to prevent damage to the electronic ballast components.

In an alternative embodiment, an output sensor 306 as a connection sensor is connected to the electronic ballast output 125. The output sensor 306 can be a voltage sensor or a current sensor, as desired. The output sensor 306 provides an output sensor signal 308 as a connection sensor signal to the control circuit 116.

When power is applied to the electronic ballast 300, the output sensor 306 monitors the electronic ballast output 125 for an electronic ballast parameter, such as output voltage or output current, and provides the output sensor signal 308 to the control circuit 116. The control circuit 116 determines whether the output sensor signal 308 is the expected connection sensor signal. The expected connection sensor signal is no signal present, indicating no voltage or current on the electronic ballast output 125 at startup. When the electronic ballast 300 has been properly wired, the output sensor signal 308 indicates no power on the electronic ballast output 125 at startup and the connection sensor signal is no signal present. The electronic ballast operation is allowed to continue.

When the electronic ballast 300 has been miswired, such as wiring the electronic ballast output 125 to the mains voltage 102, the output sensor signal 308 indicates power. Because the expected connection sensor signal is no signal present and the connection sensor signal indicates signal present, the control circuit 116 determines that miswiring has occurred and shuts down the inverter 120 to shut down the electronic ballast 300. When the electronic ballast parameter is not the expected electronic ballast parameter, the electronic ballast is shut down to prevent damage to the electronic ballast components.

In another alternative embodiment, an input sensor 302 as a first connection sensor is connected to the electronic ballast input and an output sensor 306 as a second connection sensor is connected to the electronic ballast output 125. The input sensor 302 provides an input sensor signal 304 as a first connection sensor signal to the control circuit 116 and the output sensor 306 provides an output sensor signal 308 as a second connection sensor signal to the control circuit 116. The control circuit 116 shuts down the inverter 120 to shut down the electronic ballast 300 when the input sensor signal 304 or the output sensor signal 308 is not in its expected state at startup. This provides additional assurance of proper wiring installation as both the input sensor signal 304 and the output sensor signal 308 must be in their expected state before electronic ballast operation is allowed.

Figure 4:
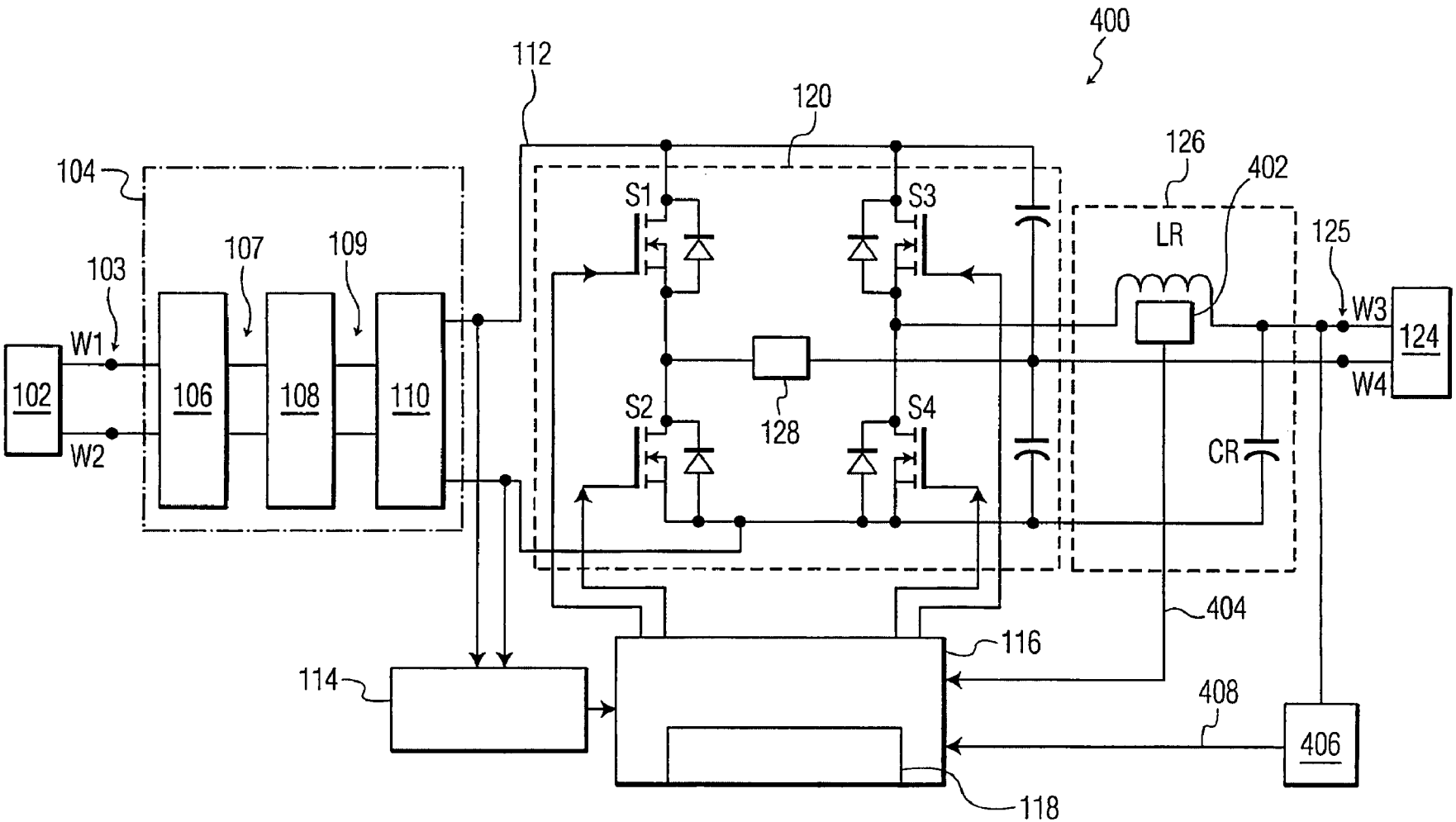
FIG. 4 is a schematic diagram of an electronic ballast circuit with ballast ignition protection made in accordance with the present invention.

FIG. 4, in which like elements share like reference numbers with FIG. 1, is a schematic diagram of an electronic ballast circuit with ballast ignition protection made in accordance with the present invention. The ignition voltage during startup includes a series of ignition voltage pulses, which are timed to limit component temperature in the electronic ballast and protect the electronic ballast.

In one embodiment, a temperature sensor 402 is provided to monitor the temperature of a ballast component, such as the resonant inductor LR, and provide a component temperature signal 404 to the control circuit 116. The component temperature can be monitored at the ballast component or on the circuit board near the ballast component. The control circuit 116 can adjust the operation of the inverter 120 to adjust timing of the series of ignition voltage pulses on the electronic ballast output 125 in response to the component temperature. Timing adjustment is discussed further in conjunction with the description of FIG. 5 below. The temperature sensor 402 is typically a semiconductor temperature sensor with a positive or negative temperature coefficient and is attached to or near the ballast component with thermally conductive epoxy.

In an alternative embodiment, a voltage sensor 406 is provided to monitor the ignition voltage at the electronic ballast output 125 during startup and to generate an ignition voltage signal 408 provided to the control circuit 116. On the initial startup after ballast installation, the control circuit 116 stores an initial output frequency corresponding to a required ignition voltage. The required ignition voltage is a high voltage which should occur at the fundamental frequency of the resonant circuit 126, or at a higher order harmonic frequency, such as the third harmonic frequency, but which actually varies from the fundamental or higher order harmonic frequency due to component tolerances and cable capacitance. The initial output frequency is determined for the installed electronic ballast, so the uncertainties are accounted for. Once the initial output frequency is known, the ignition voltage for subsequent startups as set by the control circuit 116 control of the inverter 120 begins at the initial output frequency plus a predetermined percent, such as 10 percent of the initial output frequency. The control circuit 116 sweeps the output frequency downward from the initial output frequency plus the predetermined percent to start the lamp.

In another alternative embodiment, the voltage sensor 406 is used to provide feedback to the control circuit 116. The voltage sensor 406 monitors ignition voltage as the output frequency sweeping downward from a beginning output frequency, such as a predetermined percent of the output frequency at which the required output voltage is expected to occur. The downward of the output frequency is halted when the ignition voltage reaches the required ignition voltage. The output frequency is adjusted by the control circuit 116 in response to the ignition voltage indicated by the ignition voltage signal 408 to maintain the ignition voltage at the required ignition voltage. The limited sweep from use of the voltage sensor 406 protects the ballast components from excessive heating of longer sweeps and repeated cycling from failed startup attempts.

In yet another alternative embodiment, the voltage sensor 406 is used to provide ignition indication to the control circuit 116. A lamp current sensor (not shown) monitors lamp current to the lamp 124 and provides an indication of lamp current to the control circuit 116. The control circuit 116 detects lamp breakdown indicating successful ignition based on the ignition voltage and the lamp current. The electronic ballast 400 continues to generate a high frequency current, typically at a frequency above 20 kHz, at the electronic ballast output 125 for a first period after the lamp breakdown to assure successful ignition. The first period can be as long as 500 milliseconds and is typically 50 milliseconds. After the first period, the electronic ballast 400 generates a low frequency current, typically at a frequency below 500 Hz, at the electronic ballast output 125. In one embodiment, the electronic ballast 400 generates the ignition voltage at the electronic ballast output 125 when lamp voltage and the lamp current indicate the lamp has extinguished within a second period, such as 10 seconds after the lamp breakdown. This restarts the ignition process when a previous start fails.

Figure 5:
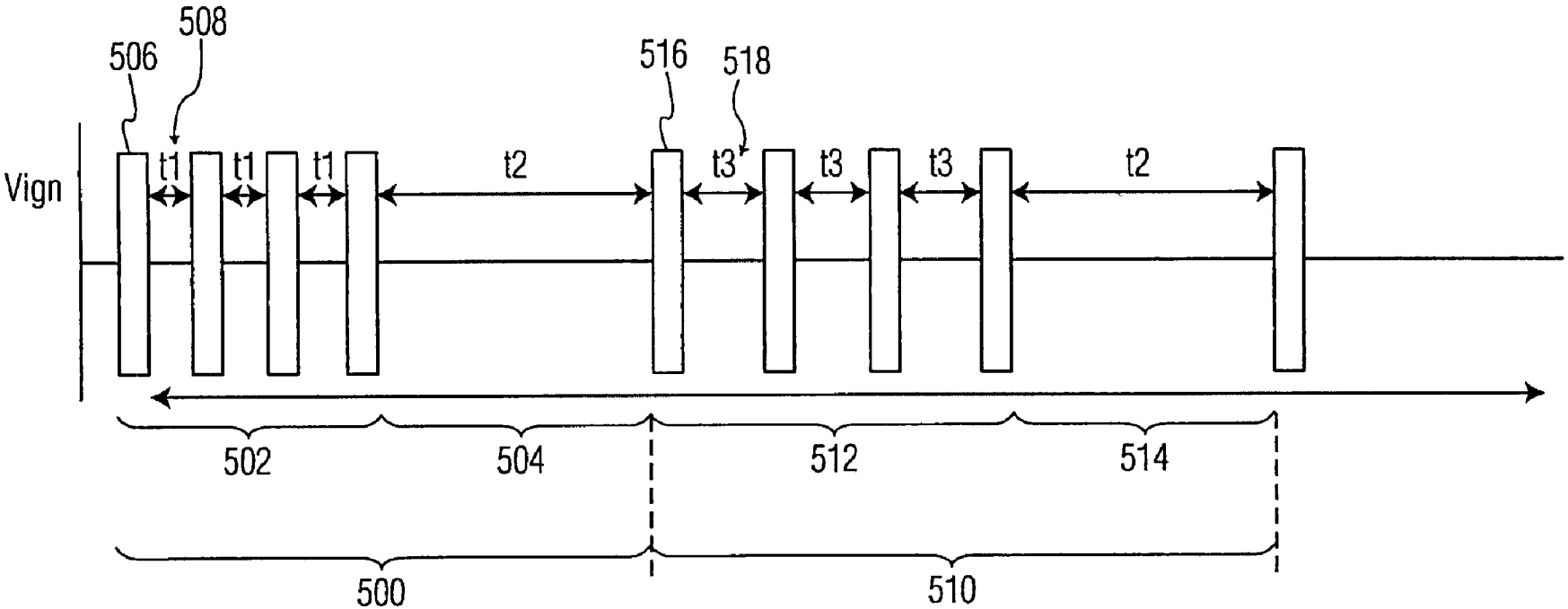
FIG. 5 is a lamp ignition voltage trace for an electronic ballast with ballast ignition protection made in accordance with the present invention.

FIG. 5 is a lamp ignition voltage trace for an electronic ballast with ballast ignition protection as in FIG. 4 above. The lamp ignition voltage includes a series of ignition voltage pulses that are timed to limit component temperature in the electronic ballast.

FIG. 5 is an exemplary trace of ignition voltage versus time, showing a first series of ignition voltage pulses and a second series of ignition voltage pulses. The first series 500 includes a pulse portion 502 and a rest portion 504. The pulse portion 502 further includes ignition voltage pulses 506 alternating with voltage spaces 508. Similarly, the second series 510 includes a pulse portion 512 and a rest portion 514, the pulse portion 512 including voltage pulses 516 alternating with voltage spaces 518. The series of ignition voltage pulses continues during startup until the lamp ignites. The series of ignition voltage pulses is typically a number of ignition voltage pulses.

Examples of ranges for the timing of the series of ignition voltage pulses are 0.01 to 3.00 seconds for the duration of each of the ignition voltage pulses 506, with a typical value of 0.90 seconds; 0.01 to 30 seconds for the duration of each of the voltage spaces 508, with a typical value of 6 seconds; 0.01 to 100 seconds for the duration of the pulse portion 502, with a typical value of 20 seconds; and 30 and 300 seconds for the duration of the rest portion 504, with a typical value of 300 seconds. The duration of each of the ignition voltage pulses 506 and each of the voltage spaces 508 is selected to prevent component temperature, such as inductor core temperature, from exceeding the component temperature breakdown limit. The duration of rest portion is selected to allow the electronic ballast component to cool down. Those skilled in the art will appreciate that the timing for a particular ballast depends on the characteristics of the particular ballast design, such as electronic ballast components used, power output, housing ventilation, heat transfer properties, insulation, and anticipated environment. The timing can be held constant from one series to the next or can be changed as desired.

The ignition voltage pulse parameters, i.e., the durations of the ignition voltage pulses, the voltage spaces, the pulse portion, and the rest portion, can be collected as values sets to be used for timing the series of ignition voltage pulses in particular situations. For example, when the component temperature is in a temperature band away from the component temperature breakdown limit, the timing of the series of ignition voltage pulses can be a first values set at the lower end of the range for the ignition voltage pulse parameters. When the component temperature is in a temperature band near the component temperature breakdown limit, the timing of the series of ignition voltage pulses can be a second values set at the upper end of the range for the ignition voltage pulse parameters. When the component temperature is in a temperature band above the component temperature breakdown limit, the ignition voltage can be shut down to protect the ballast component.

The series of ignition voltage pulses are timed to limit component temperature in the electronic ballast. In one embodiment, the timing is calculated for a particular electronic ballast design and the timing is maintained the same for the service life of the ballast. In an alternative embodiment, the timing is adjusted dynamically in response to an electronic ballast measurement, such as component temperature, and the timing can change during a given startup. In another alternative embodiment, the timing can be adjusted from one lamp startup to another, based on performance during the previous startup or a previous series of startups.

While the embodiments of the invention disclosed herein are presently considered to be preferred, various changes and modifications can be made without departing from the scope of the invention. The scope of the invention is indicated in the appended claims, and all changes that come within the meaning and range of equivalents are intended to be embraced therein.

The invention claimed is:

1. A method of electronic ballast protection comprising:

providing an electronic ballast, the electronic ballast having an AC/DC converter 104 having an electronic ballast input and a mains voltage connection 103 connectable to a mains voltage 102, an inverter 120 operably connected to the AC/DC converter 104 and having an electronic ballast output 125 connectable to a lamp 124, a control circuit 116 controlling the inverter 120, and a low voltage power supply 114 providing low voltage power to the control circuit 116;

supplying power to the low voltage power supply 114 from the electronic ballast input when the mains voltage connection 103 is wired to the mains voltage 102; and disconnecting the power to the low voltage power supply 114 when the electronic ballast output 125 is wired to the mains voltage 102.

2. The method of claim 1 wherein the AC/DC converter 104 receives the mains voltage 102 at a mains voltage connection 103; the AC/DC converter 104 comprises an EMI filter 106 operably connected to a diode bridge 108 at an EMI filter-diode bridge connection 107, and a DC/DC converter 110 operably connected to the diode bridge 108 at a diode bridge—DC/DC converter connection 109; and the electronic ballast input is selected from the group consisting of the mains voltage connection 103, the EMI filter-diode bridge connection 107, and the diode bridge-DC/DC converter connection 109.

3. A system of electronic ballast protection comprising:

an electronic ballast, the electronic ballast having an AC/DC converter 104 having an electronic ballast input and a mains voltage connection 103 connectable to a mains voltage 102, an inverter 120 operably connected to the AC/DC converter 104 and having an electronic ballast output 125 connectable to a lamp 124, a control circuit 116 controlling the inverter 120, and a low voltage power supply 114 providing low voltage power to the control circuit 116;

means for supplying power to the low voltage power supply 114 from the electronic ballast input when the mains voltage connection 103 is wired to the mains voltage 102; and means for disconnecting the power to the low voltage power supply 114 when the electronic ballast output 125 is wired to the mains voltage 102.

4. An electronic ballast with ballast protection comprising:

an AC/DC converter 104, the AC/DC converter 104 receiving mains voltage 102 at a mains voltage connection 103 and generating DC bus voltage from the mains voltage 102, the AC/DC converter 104 having an electronic ballast input;

an inverter 120, the inverter 120 receiving the DC bus voltage and generating output power at an electronic ballast output 125 connectable to a lamp 124;

a control circuit 116, the control circuit 116 controlling the inverter 120; and a connection sensor, the connection sensor operably connected to a location selected from the group consisting of the electronic ballast input and the electronic ballast output 125;

wherein the connection sensor provides a connection sensor signal to the control circuit 116, and the control circuit 116 shuts down the inverter 120 when the connection sensor signal is not an expected connection sensor signal, lack of the expected connection sensor signal resulting from a miswire selected from the group consisting of connection of the mains voltage 102 with the electronic ballast output 125 and connection of the lamp 124 with the mains voltage connection 103.

5. The electronic ballast of claim 4 wherein the connection sensor is an input sensor 302 connected to the electronic ballast input, the connection sensor signal is an input sensor signal 304, and the expected connection sensor signal is a signal present.

6. The electronic ballast of claim 5 wherein the input sensor 302 is selected from the group consisting of a voltage sensor and a current sensor.

7. The electronic ballast of claim 5 wherein the AC/DC converter 104 receives the mains voltage 102 at a mains voltage connection 103; the AC/DC converter 104 comprises an EMI filter 106 operably connected to a diode bridge 108 at an EMI filter-diode bridge connection 107, and a DC/DC converter 110 operably connected to the diode bridge 108 at a diode bridge-DC/DC converter connection 109; and the electronic ballast input is selected from the group consisting of the mains voltage connection 103, the EMI filter-diode bridge connection 107, and the diode bridge-DC/DC converter connection 109.

8. The electronic ballast of claim 4 wherein the connection sensor is an output sensor 306 connected to the electronic ballast output 125, the connection sensor signal is an output sensor signal 308, and the expected connection sensor signal is no signal present.

9. The electronic ballast of claim 8 wherein the output sensor 306 is selected from the group consisting of a voltage sensor and a current sensor.

10. A method of electronic ballast protection comprising:

providing an electronic ballast having an electronic ballast input connectable to a mains voltage and an electronic ballast output connectable to a lamp;

monitoring an electronic ballast parameter at a location selected from the group consisting of the electronic ballast input and the electronic ballast output; and shutting down the electronic ballast when the electronic ballast parameter is not an expected electronic ballast parameter, lack of the expected connection sensor signal resulting from a miswire selected from the group consisting of connection of the mains voltage with the electronic ballast output and connection of the lamp with the electronic ballast input.

11. The method of claim 10 wherein the electronic ballast parameter is an electronic ballast input parameter monitored at the electronic ballast input, and the expected electronic ballast parameter is a parameter present.

12. The method of claim 11 wherein the electronic ballast input parameter is selected from the group consisting of voltage and current.

13. The method of claim 10 wherein the electronic ballast parameter is an electronic ballast output parameter monitored at the electronic ballast output, and the expected electronic ballast parameter is no parameter present.

14. The method of claim 13 wherein the electronic ballast output parameter is selected from the group consisting of voltage and current.

15. A system of electronic ballast protection comprising:

an electronic ballast having an electronic ballast input connectable to a mains voltage 102 and an electronic ballast output 125 connectable to a lamp 124;

means for monitoring an electronic ballast parameter at a location selected from the group consisting of the electronic ballast input and the electronic ballast output 125; and means for shutting down the electronic ballast when the electronic ballast parameter is not an expected electronic ballast parameter, lack of the expected connection sensor signal resulting from a miswire selected from the group consisting of connection of the mains voltage with the electronic ballast output and connection of the lamp with the electronic ballast input.

16. A method of electronic ballast protection comprising:

providing an electronic ballast, the electronic ballast having an electronic ballast output 125; and generating an ignition voltage at the electronic ballast output 125 during lamp startup, the ignition voltage comprising a series of ignition voltage pulses;

wherein the series of ignition voltage pulses are timed so as to limit component temperature in the electronic ballast.

17. The method of claim 16 wherein the series of ignition voltage pulses comprises a pulse portion and a rest portion.

18. The method of claim 17 wherein duration of the pulse portion is between 0.01 and 100 seconds and duration of the rest portion is between 30 and 300 seconds.

19. The method of claim 17 wherein the pulse portion comprises the ignition voltage pulses alternating with voltage spaces.

20. The method of claim 19 wherein duration of each of the ignition voltage pulses is between 0.01 and 3.00 seconds and duration of each of the voltage spaces is between 0.01 and 30 seconds.

21. The method of claim 16 further comprising monitoring the component temperature, and adjusting timing of the series of ignition voltage pulses in response to the component temperature.

22. The method of claim 21 wherein the adjusting timing of the series of ignition voltage pulses in response to the component temperature comprises maintaining ignition voltage pulse parameters at a first values set when the component temperature is in a first temperature band and maintaining the ignition voltage pulse parameters at a second values set when the component temperature is in a second temperature band.

23. The method of claim 22 further comprising shutting down the ignition voltage when the component temperature is in a third temperature band.

24. The method of claim 21 wherein the monitoring the component temperature comprises monitoring the component temperature at a location selected from on a resonant inductor and on a circuit board near the resonant inductor.

25. The method of claim 16 further comprising:

monitoring ignition voltage;

storing an initial output frequency corresponding to a required ignition voltage during initial startup;

starting the ignition voltage at the initial output frequency plus a predetermined percent on a subsequent startup; and sweeping output frequency downward from the initial output frequency plus the predetermined percent.

26. The method of claim 16 further comprising:

monitoring ignition voltage;

sweeping output frequency downward from a beginning output frequency;

halting the sweeping output frequency downward when the ignition voltage reaches a required ignition voltage; and adjusting the output frequency in response to the ignition voltage to maintain the ignition voltage at the required ignition voltage.

27. The method of claim 16 further comprising:

monitoring ignition voltage and lamp current;

detecting lamp breakdown based on the ignition voltage and the lamp current;

generating a high frequency current at the electronic ballast output 125 for a first period after the lamp breakdown; and generating a low frequency current at the electronic ballast output 125 after the first period.

28. The method of claim 27 further comprising generating the ignition voltage at the electronic ballast output 125 when lamp voltage and the lamp current indicate the lamp extinguished within a second period.

29. A system of electronic ballast protection comprising:

an electronic ballast, the electronic ballast having an electronic ballast output 125; and means for generating an ignition voltage at the electronic ballast output 125 during lamp startup, the ignition voltage comprising a series of ignition voltage pulses;

wherein the series of ignition voltage pulses are timed so as to limit component temperature in the electronic ballast.

30. The system of claim 29 further comprising means for measuring the component temperature and means for adjusting timing of the series of ignition voltage pulses in response to the component temperature.

31. The system of claim 29 further comprising:

means for monitoring ignition voltage;

means for storing an initial output frequency generating a required ignition voltage during initial startup;

means for starting the ignition voltage at the initial output frequency plus a predetermined percent on a subsequent startup; and means for sweeping frequency downward from the initial output frequency plus the predetermined percent.

32. The system of claim 29 further comprising:

means for monitoring ignition voltage and lamp current;

means for detecting lamp breakdown based on the ignition voltage and the lamp current;

means for generating a high frequency current at the electronic ballast output 125 for a first period after the lamp breakdown; and means for generating a low frequency current at the electronic ballast output 125 after the first period.

33. The system of claim 32 further comprising means for generating the ignition voltage at the electronic ballast output 125 when lamp voltage and the lamp current indicate the lamp extinguished within a second period.

* * * * *